United States Patent [19]

Jansen

[11] 3,987,426

[45] Oct. 19, 1976

[54] POWER LOSS INDICATOR

[75] Inventor: Bernard L. Jansen, Denver, Colo.

[73] Assignee: The Raymond Lee Organization, Inc., a part interest

[22] Filed: July 21, 1975

[21] Appl. No.: 597,497

[52] U.S. Cl. ..... 340/253 C; 340/373

[51] Int. Cl.[2] ..... G08B 21/00

[58] Field of Search ..... 335/272; 340/378 MM, 340/373, 248 B, 253 C

[56] References Cited

UNITED STATES PATENTS

| | | | |
|---|---|---|---|
| 2,488,824 | 11/1949 | Olie | 340/248 B |
| 2,632,887 | 3/1953 | Rusnak | 340/253 C |
| 2,677,817 | 5/1954 | Rorden et al. | 340/373 X |
| 2,970,305 | 1/1961 | Walters | 340/253 C |
| 3,375,512 | 3/1968 | Watkins et al. | 335/272 X |
| 3,678,426 | 7/1972 | Pihl | 335/272 X |
| 3,820,047 | 6/1974 | Juhnke | 335/272 X |

*Primary Examiner*—George Harris

[57] ABSTRACT

A housing is supported in front of a conventional female wall socket by a conventional two-prong male plug that extends out the rear of the housing and engages the socket. A flag is pivotally secured to the housing and can be pivoted into or out of it in a vertical plane parallel to the wall socket. Normally the flag is retained in the housing. When there is an interruption in the supply of electric power to the socket, the flag will pivot out of the housing automatically.

5 Claims, 3 Drawing Figures

POWER LOSS INDICATOR

SUMMARY OF THE INVENTION

The object of the invention is to provide a device that can be used to provide a visual indication that there has been a loss of electrical power to the wall socket into which the device is plugged. A further object of the invention is to provide a device that will indicate whether or not power has been restored after failure.

Thus, an exterior housing is supported in a conventional female socket by a conventional two-pronged male plug that extends out of the housing. A flat is located in the housing. Normally, the flag is retained in the housing. However, upon a power failure at the socket, the flag will be moved automatically out of the housing, to protrude therefrom and thereby indicate that a power failure has occurred. In order to determine whether or not the power failure is continuing, the user can push the flag back into the housing. If the flag is relocked in place inside the housing, the power failure has ended. If the flag will not remain inside the housing, but rather moves out of it, the power failure is ongoing.

DETAILED DESCRIPTION OF PREFERRED EMBODIMENTS

Figure 1:
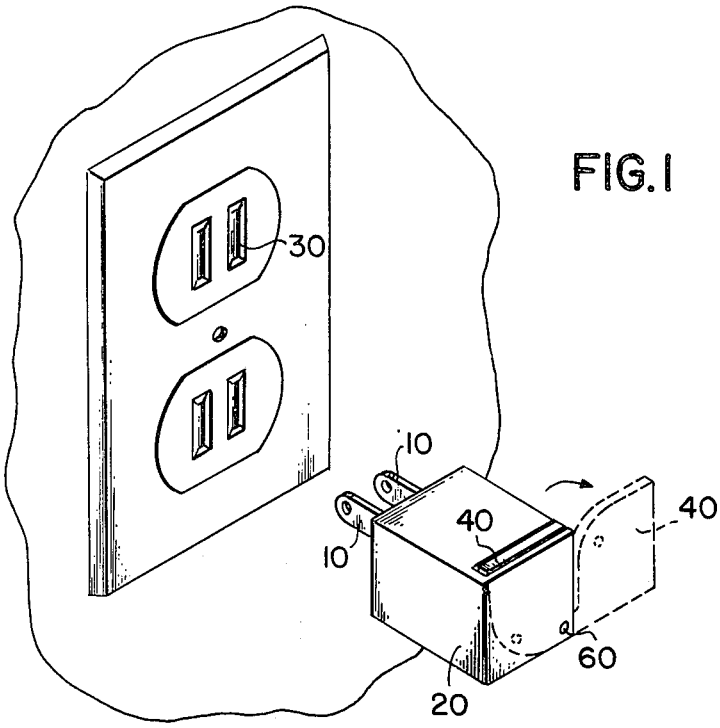
FIG. 1 shows the invention ready for use.
Figure 3:
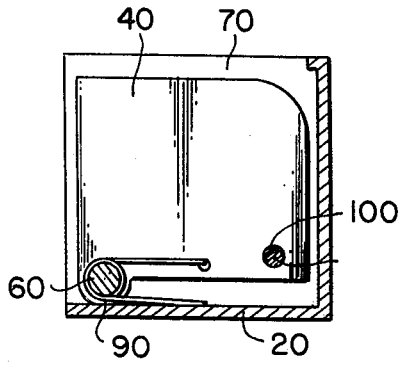
FIG. 3 is a detail view of the torsion spring and surround structure.
Figure 2:
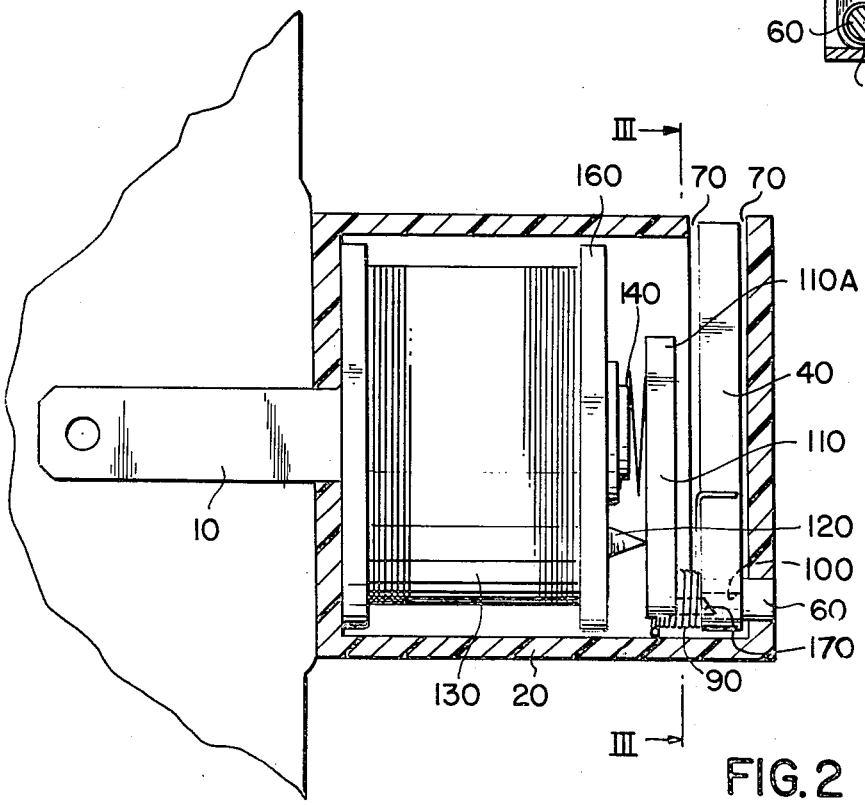
FIG. 2 is a cross-sectional view of the invention.

Referring now to FIGS. 1–3, conductive male prongs 10 extend rearwardly out of rectangular housing 20. The prongs can be plugged into conventional female wall socket 30 to support the housing in front of the socket. As can be seen in FIG. 1, a flat flat 40, which takes the form of a brightly colored square plate with one corner rounded off, can be pivoted by torsion spring 90 about a horizontal axis in a vertical plane parallel to the wall containing socket 30. A bearing 60 disposed in an end wall of the housing and secured to the flag facilitates pivoting.

When the flag is disposed within slot 70, as is normally the case, the flag is invisible. However when the flag is pivoted outside the housing as shown is dotted line in FIG. 1 the flag is exposed and visible.

An electromagnet having windings 130 and vertical end plate 160 is disposed in the housing. The electromagnet is energized by flow of current between the two prongs and through the winding 130. The electromagnet is deenergized when current flow fails, that is when there is a power failure.

The electromagnet plate 160 carries an off center horizontally extending pivot point or fulcrum 120. A generally vertical lever 110 has at least a portion 110A which is magnetic. If desired, the lever can have an opening into which a magnetic body can be inserted. A coil spring 140 centered on the centers of plate 160 and lever 110 extends therebetween horizontally. The spring is secured at one end to the plate and at the other end to the lever. The spring end secured to the lever is disposed between the magnetic portion 110A and the fulcrum. It is not necessary that the lever contain only the magnetic portion 110A but it is necessary that the magnetic action shall be as described below.

When the electromagnet is energized, the magnetic force of attraction established between plate 160 and the lever causes the top portion of the lever above the fulcrum to move toward the plate, and the small bottom portion of the lever below the fulcrum to move away from the plate. A horizontally elongated pin 170 secured to the bottom of this small portion of the lever is moved away from the plate 160 and into engagement with a transverse hole 100 in the flag. This prevents any transverse pivoting or rotation of the flat despite action of the torsion spring. The flag is thus held in the housing.

If power fails, the magnetic force of attraction disappears. The spring 140 moves the top portion of the lever away from plate 160 whereby the bottom portion of the lever moves toward plate 160. Pin 170 is thus withdrawn from hole 100. Spring 90 then pivots the flag out of the housing to signify power failure. Once the flag is out, it must be manually reset inside the housing. If power has not been restored, the manual reset will not keep the flag inside the housing since the torsion spring will pivot the flag outward as soon as manual pressure is removed.

Although the invention has been described with particular reference to the drawings, the protection sought is to be limited only by the terms of the claims which follow.

What is claimed is:

1. A device for indicating loss of electric power in a socket, said device comprising:

a hollow housing having a vertical slot;

a vertical flag disposed in the slot;

first means in the housing for pivoting said flag in a vertical plane between a first position at which the flag is completely disposed within the housing and a second position at which at least a portion of the flag is disposed outside the housing, said first means being responsive to the presence of a magnetic field to hold the flag in the first position and thereafter reacting to the absence of said field to place the flag in the second position;

an electromagnet in said housing which when energized produces said field, said field disappearing when the electromagnet is deenergized; and second means supported partially in the housing and connected to said electromagnet, said second means detachably engaging said socket and energizing said magnet when said power is present in the socket.

2. The device of claim 1 wherein said electromagnet has a vertical plate parallel and spaced from said flag, said first means including a fulcrum on said plate and a lever pivotable about the fulcrum to a first position when the electromagnet is energized and to a second position when the electromagnet is deenergized, said lever having magnetic properties.

3. The device of claim 2 wherein said flag has a transverse hole and said lever has a horizontal pin which is moved into said hole when the electromagnet is energized and is moved out of the hole when the electromagnet is deenergized.

4. The device of claim 3 wherein said first means includes a coil spring secured to and extending between said plate and said lever.

5. The device of claim 4 wherein said first means includes a torsion spring for pivoting the flag into its second position when said pin is withdrawn from said hole.

* * * * *